US007728524B2

(12) United States Patent
Kang

(10) Patent No.: US 7,728,524 B2
(45) Date of Patent: Jun. 1, 2010

(54) PLASMA DISPLAY PANEL HAVING TRANSVERSE BARRIER RIBS

(75) Inventor: Tae-Kyoung Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 522 days.

(21) Appl. No.: 11/693,996

(22) Filed: Mar. 30, 2007

(65) Prior Publication Data

US 2007/0228959 A1 Oct. 4, 2007

(30) Foreign Application Priority Data

Mar. 30, 2006 (KR) ..... 10-2006-0029114

(51) Int. Cl.
*H01J 17/49* (2006.01)

(52) U.S. Cl. ..... 313/587; 313/584; 313/585; 313/586

(58) Field of Classification Search ..... 313/582–587
See application file for complete search history.

(56) References Cited

U.S. PATENT DOCUMENTS

2004/0000873 A1 1/2004 Moon
2007/0228953 A1* 10/2007 Soh et al. ..... 313/582
2007/0228973 A1* 10/2007 Soh et al. ..... 313/584

FOREIGN PATENT DOCUMENTS

KR 2004-1645 1/2004

OTHER PUBLICATIONS

Office Action issued May 29, 2007 by the Korean Intellectual Property Office re: Korean Application No. 2006-29114 (3 pp).

* cited by examiner

*Primary Examiner*—Bumsuk Won
(74) *Attorney, Agent, or Firm*—Stein McEwen, LLP

(57) ABSTRACT

A plasma display panel (PDP) in which high luminance images can be formed at low voltage. The PDP includes first and second substrates which with a predetermined space therebetween; a plurality of barrier ribs disposed between the first and second substrates, including longitudinal barrier ribs and transverse barrier ribs having a height 10~50% lower than the longitudinal barrier ribs in a direction towards the first substrate and connecting the longitudinal barrier ribs, the plurality of barrier ribs defining a plurality of discharge cells together with the first and second substrates; a plurality of pairs of sustain electrodes crossing the longitudinal barrier ribs; and a plurality of address electrodes to cross the pairs of sustain electrodes; and a fluorescent layer formed in each of the discharge cells.

24 Claims, 6 Drawing Sheets

PLASMA DISPLAY PANEL HAVING TRANSVERSE BARRIER RIBS

CROSS-REFERENCE TO RELATED PATENT APPLICATIONS

This application claims the benefit of Korean Patent Application No. 2006-29114, filed Mar. 30, 2006, in the Korean Intellectual Property Office, the disclosure of which is incorporated herein in its entirety by reference.

BACKGROUND OF THE INVENTION

1. Field of the Invention

Aspects of the present invention relate to a plasma display panel (PDP), and more particularly, to a PDP in which high luminance images can be formed at low voltage.

2. Description of the Related Art

Plasma display panels (PDPs) are flat display panels for forming images by exciting a fluorescent material using ultraviolet (UV) rays generated from a gas discharge. PDPs are regarded as next generation flat display panel due to their slim, large screens that display high resolution images. PDPs include pairs of sustain electrodes and dielectrics and a protection layer to protect the pairs of sustain electrodes.

To increase discharge efficiency of PDPs, the distance between the sustain electrodes of the pairs of sustain electrodes is increased as much as possible such that a discharge is effectively diffused in the discharge cells.

However, in conventional PDPs, when the distance between the sustain electrodes of the pairs of sustain electrodes is increased, the discharge is not diffused effectively due to barrier ribs which define the discharge cells. PDPs include barrier ribs disposed between the two substrates and have a predetermined space therebetween. Some of the barrier ribs extend in a direction parallel to the pairs of sustain electrodes, which are stripe-shaped. Accordingly, when the distance between the sustain electrodes is longer, the sustain electrodes are disposed near the upper portion of the barrier ribs, which are also stripe-shaped. As a result, the discharge between the sustain electrodes is blocked by the neighboring barrier ribs such that the discharge is not effectively diffused in the discharge cells.

SUMMARY OF THE INVENTION

Aspects of the present invention provide a plasma display panel (PDP) in which high luminance images can be formed at low voltage.

According to an aspect of the present invention, there is provided a PDP including first and second substrates which face each other with a predetermined space therebetween; a plurality of barrier ribs disposed between the first and second substrates, including longitudinal barrier ribs extending in a first direction and transverse barrier ribs having a height less than the longitudinal barrier ribs and connecting the longitudinal barrier ribs, the plurality of barrier ribs defining a plurality of discharge cells together with the first and second substrates; a plurality of pairs of sustain electrodes disposed on the first substrate, extending in a second direction to cross the longitudinal barrier ribs and corresponding to the discharge cells, each pair of the sustain electrodes including first and second sustain electrodes separated by a distance from each other; a plurality of address electrodes disposed on the second substrate to cross the pairs of sustain electrodes; and a fluorescent layer formed in each of the discharge cells.

The transverse barrier ribs may have a height about 10% to 50% lower than the height of the longitudinal barrier ribs.

The distance between the first and second sustain electrodes of each pair of the sustain electrodes may be greater than the height of the transverse barrier ribs.

The distance between the first and second sustain electrodes of each pair of the sustain electrodes may be greater than the height of the longitudinal barrier ribs.

The distance between the first and second sustain electrodes of each pair of the sustain electrodes may be greater than the height of the barrier ribs.

The first and second sustain electrodes of each pair of the sustain electrodes may be disposed to correspond to the upper portion of the transverse barrier ribs.

The first and second sustain electrodes of each pair of the sustain electrodes may further include first and second bus electrodes, respectively, and the first and second bus electrodes may be disposed to correspond to the upper portion of the transverse barrier ribs.

According to another aspect of the present invention, there is provided a PDP including first and second substrates which face each other with a predetermined space therebetween; a plurality of barrier ribs disposed between the first and second substrates, including longitudinal barrier ribs extending in a first direction and transverse barrier ribs connecting the longitudinal barrier ribs, the plurality of barrier ribs defining a plurality of discharge cells together with the first and second substrates; a plurality of pairs of sustain electrodes disposed on the first substrate, extending in a second direction to cross the longitudinal barrier ribs and correspond to the discharge cells, and each pair of the sustain electrodes including first and second sustain electrodes separated by a distance from each other; a plurality of address electrodes disposed on the second substrate to cross the pairs of sustain electrodes; and a fluorescent layer formed in each of the discharge cells, the fluorescent layer being formed to expose upper ends of sidewalls of the transverse barrier ribs in a direction from the second substrate towards the first substrate.

The distance between the first and second sustain electrodes of each pair of the sustain electrodes may be greater than the height of the barrier ribs.

The height of the fluorescent layers formed on the sidewalls of the transverse barrier ribs may be less than the height of the fluorescent layers formed on sidewalls of the longitudinal barrier ribs.

The distance between the first and second sustain electrodes of each pair of the sustain electrodes may be greater than the height of the transverse barrier ribs.

The first and second sustain electrodes of each pair of the sustain electrodes may be disposed to correspond to the upper portion of the transverse barrier ribs.

The first and second sustain electrodes of each pair of the sustain electrodes may further include first and second bus electrodes, respectively, and the first and second bus electrodes may disposed to correspond to the upper portion of the transverse barrier ribs.

According to another aspect of the present invention, there is provided a PDP including first and second substrates which face each other with a predetermined space therebetween; a plurality of barrier ribs disposed between the first and second substrates, including longitudinal barrier ribs extending in a first direction and transverse barrier ribs connecting the longitudinal barrier ribs, the plurality of barrier ribs defining a plurality of discharge cells together with the first and second substrates; a plurality of pairs of sustain electrodes disposed on the first substrate, extending in a second direction to cross the longitudinal barrier ribs and correspond to the discharge cells, and each pair of the sustain electrodes including first and second sustain electrodes separated by a distance from each other; a plurality of address electrodes disposed on the second substrate to cross the pairs of sustain electrodes; and a fluorescent layer formed in each of the discharge cells, in which the thickness of the fluorescent layer formed on sidewalls of the transverse barrier ribs is less than the thickness of the fluorescent layer formed on the second substrate.

The distance between the first and second sustain electrodes of each pair of the sustain electrodes may be greater than the height of the barrier ribs.

The first and second sustain electrodes of each pair of the sustain electrodes may be disposed to correspond to the upper portion of the transverse barrier ribs.

The first and second sustain electrodes of each pair of the sustain electrodes may further include first and second bus electrodes, respectively, and the first and second bus electrodes may be disposed to correspond to the upper portion of the transverse barrier ribs.

The PDP according to aspects of the present invention may further include a second dielectric layer to cover the address electrodes.

According to another aspect of the present invention, a plasma display panel is provided, including: first and second substrates which face each other with a predetermined space therebetween; a plurality of barrier ribs disposed between the first and second substrates, comprising longitudinal barrier ribs extending in a first direction and transverse barrier ribs connecting the longitudinal barrier ribs, the plurality of barrier ribs defining a plurality of discharge cells together with the first and second substrates; a plurality of pairs of sustain electrodes disposed on the first substrate, extending in a second direction to cross the longitudinal barrier ribs and correspond to the discharge cells, and each pair of the sustain electrodes comprising first and second sustain electrodes separated by a distance from each other; a plurality of address electrodes disposed on the second substrate to cross the pairs of sustain electrodes; and a fluorescent layer formed in each of the discharge cells, wherein the height of the fluorescent layer formed on sidewalls of the transverse barrier ribs is lower than the height of the longitudinal barrier ribs.

According to another aspect, the first sustain electrodes are disposed to correspond to the upper portion of the transverse barrier ribs, and the second sustain electrodes are disposed to correspond to the upper portion of adjacent transverse barrier ribs.

According to another aspect, the first and second sustain electrodes of each pair of the sustain electrodes further comprise first and second bus electrodes, respectively, and the first bus electrodes are disposed to correspond to the upper portion of the transverse barrier ribs, and the second sustain electrodes are disposed to correspond to the upper portion of adjacent transverse barrier ribs.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
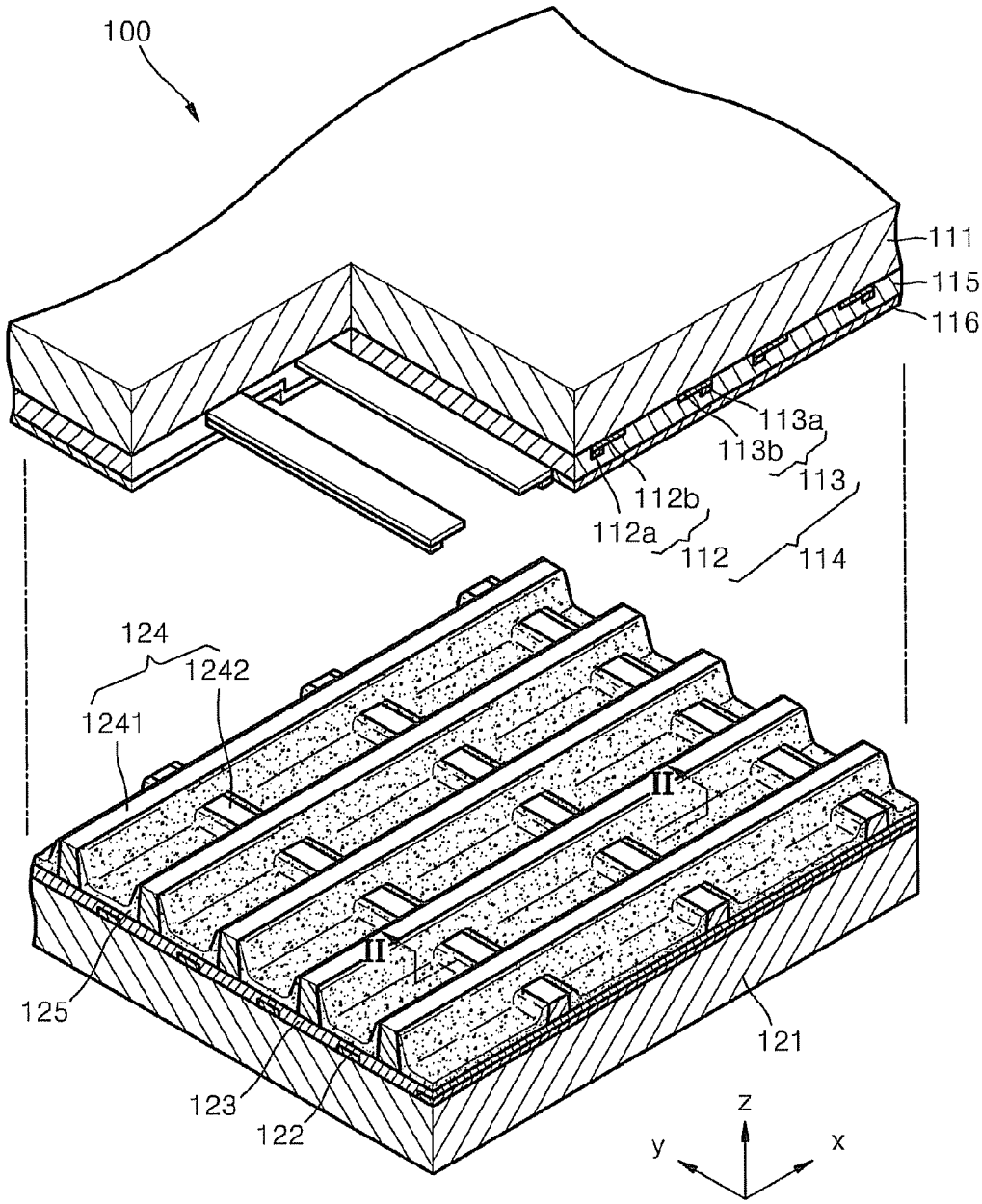
FIG. 1 is a schematic exploded perspective view of a plasma display panel (PDP) according to an aspect of the present invention.

Reference will now be made in detail to the aspects of the present invention, examples of which are illustrated in the accompanying drawings, wherein like reference numerals refer to the like elements throughout. The embodiments are described below in order to explain the aspects of the present invention by referring to the figures.

Figure 2:
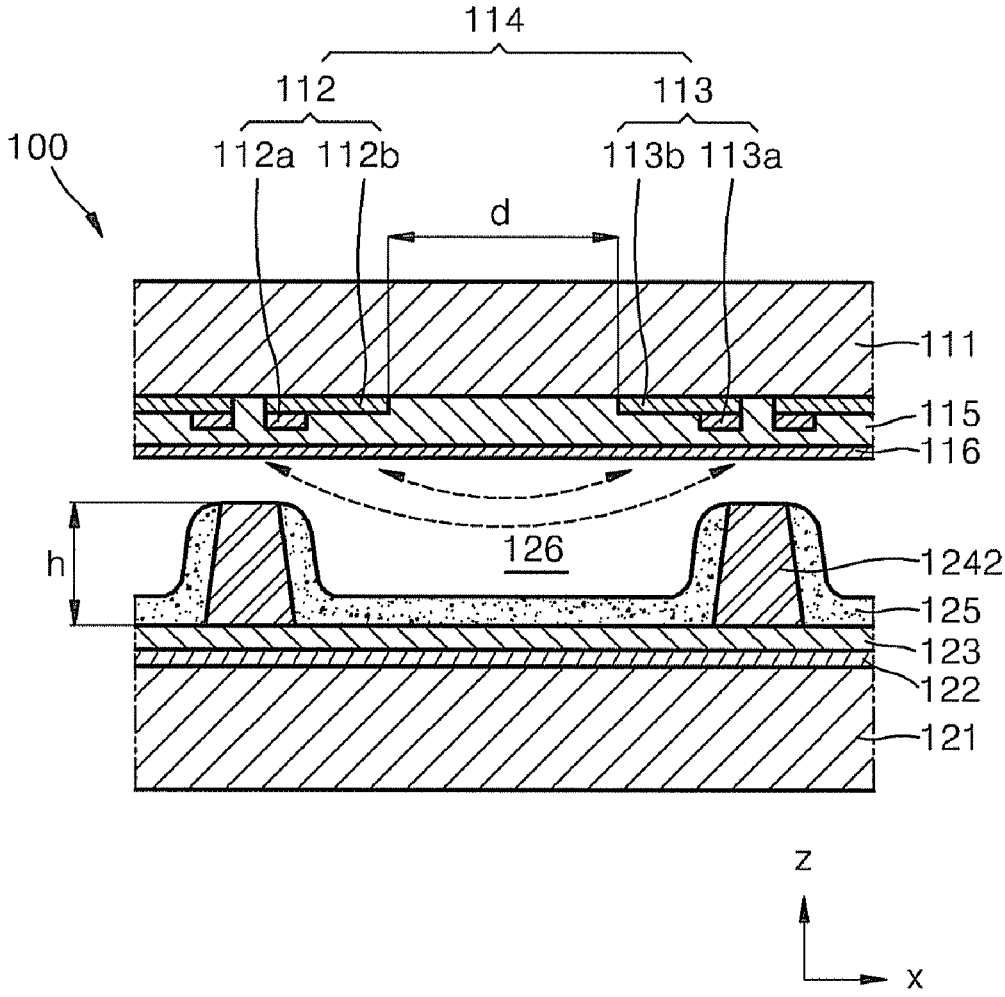
FIG. 2 is a schematic cross-sectional view of the PDP taken along a line II-II illustrated in FIG. 1.

FIG. 1 is a schematic exploded perspective view of a plasma display panel (PDP) 100 according to an aspect of the present invention and FIG. 2 is a schematic cross-sectional view of the PDP 100 taken along a line II-II illustrated in FIG. 1.

Referring to FIGS. 1 and 2, a first substrate 111 and a second substrate 121 are disposed to face each other with a predetermined space therebetween. The first and second substrates 111 and 121 can be formed of a transparent material such as glass. A plurality of barrier ribs 124 are disposed between the first and second substrates 111 and 121. FIG. 1 illustrates the barrier ribs 124 disposed on the second substrate 121 facing the first substrate 111. However, the barrier ribs 124 can also be disposed on the first substrate 111 to face the second substrate 121, or on both the first and second substrates 111 and 121.

The barrier ribs 124 define a plurality of discharge cells 126 together with the first and second substrates 111 and 121. The barrier ribs 124 include longitudinal barrier ribs 1241 and transverse barrier ribs 1242. The longitudinal barrier ribs 1241 are disposed to extend in a first direction (X direction of FIG. 1) and the transverse barrier ribs 1242 are disposed to connect the longitudinal barrier ribs 1241. In this case, the height of the transverse barrier ribs 1242 is less than the height of longitudinal barrier ribs 1241. That is, the transverse barrier ribs 1242 are lower than the longitudinal barrier ribs 1241 in a direction (Z direction of FIG. 1) towards the first substrate 111 from the second substrate 121. The effect thereof will be described later.

The discharge cells 126 defined by the first and second substrates 111 and 121 and the barrier ribs 124 include pairs of sustain electrodes 114 including first and second sustain electrodes 112 and 113, respectively, which are separated from each other. That is, the PDP 100 includes pairs of sustain electrodes 114 which extend in a second direction (Y direction) to cross the longitudinal barrier ribs 1241 and correspond to the discharge cells 126. In FIGS. 1 and 2, the pairs of sustain electrodes 114 are disposed on the first substrate 111 to face the second substrate 121, but the present invention is not limited thereto.

The first and second sustain electrodes 112 and 113 are used for a sustain discharge. The sustain discharge, which is used for forming an image on the PDP 100, occurs between the first and second sustain electrodes 112 and 113.

The first and second sustain electrodes 112 and 113 can be formed of a conductive metal such as Al or Cu. When light generated in the PDP 100 is emitted in a direction from the discharge cells 126 toward the pairs of sustain electrodes 114, in other words, when light is emitted through the first substrate 111, the pairs of sustain electrodes 114 may be formed to be transparent. To form transparent electrodes, a transparent material such as indium tin oxide (ITO) can be used.

The first and second sustain electrodes 112 and 113 may further include first and second bus electrodes 112*a* and 113*a*, respectively, when needed. Since transparent portions 112*b* and 113*b* of the first and second sustain electrodes 112 and 113 generally have a high resistance, the first and second bus electrodes 112*a* and 113*a* are included to prevent a voltage drop due to the high resistance. Accordingly, the first and second bus electrodes 112*a* and 113*a* may be formed of Ag, Cu, Au, or Al, which have low resistances and high conductivities. Also, the first and second bus electrodes 112*a* and 113*a* may include a black additive or have a multilayer structure including a layer formed of a black material, thereby improving contrast in the produced image.

The first and second sustain electrodes 112 and 113 are connected to a connection cable, which is disposed at the edge of the PDP 100, to be supplied with electricity. According to aspects of the present invention, only the first and second bus electrodes 112*a* and 113*a* may be connected to the connection cable, but the present invention is not limited thereto.

The pairs of sustain electrodes 114 are covered by a first dielectric layer 115 such that the first and second sustain electrodes 112 and 113 of the pairs of sustain electrodes 114 are electrically insulated from each other and cannot be damaged by charged particles colliding against the sustain electrodes 112 and 113. The first dielectric layer 115 may be formed of PbO, $B_2O_3$, or $SiO_2$. When light generated in the PDP 100 is emitted through the first substrate 111, the first dielectric layer 115 may be formed of a transparent material.

Meanwhile, a protection layer 116 is further included to protect the first dielectric layer 115 during discharge. The protection layer 116 may be formed of PbO, $B_2O_3$, $SiO_2$, MgO, or the like using a wet coating method such as dipping, spraying, spin coating, or the like. The protection layer 116 protects the first dielectric layer 115 and activates a discharge by a secondary emission.

In the PDP 100 illustrated in FIGS. 1 and 2 according to aspects of the present invention, the pairs of sustain electrodes 114 extend in the Y direction to cross the longitudinal barrier ribs 1241, and a plurality of address electrodes 122 extend in the X direction to cross the pairs of sustain electrodes 114. In this electrode arrangement, an address discharge occurs between the address electrodes 122 and at least one of the first and second sustain electrodes 112 and 113. Then, a sustain discharge occurs between the first and second sustain electrodes 112 and 113.

As described above, at least one address electrode 122 in addition to two discharge electrodes (one pair of discharge electrodes), generally known as X and Y electrodes, can be further included in each of the discharge cells 126 of the PDP 100 to provide the address discharge and the sustain discharge. The address discharge occurs between the Y electrode and the address electrode 122. When the address electrodes 122 are disposed below the first and second sustain electrodes 112 and 113 as in the PDP 100 according to aspects of the current embodiment, one of the first or second sustain electrodes 112 or 113 may be the Y electrode and the other may be the X electrode. The address electrodes 122 can be formed of a conductive metal.

The address electrodes 122 can be disposed on the second substrate 121 to face the first substrate 111. A second dielectric layer 123 can be further included to cover the address electrodes 122 such that the address electrodes 122 can be prevented from being damaged by charged particles colliding against the address electrodes 122 during discharge. The second dielectric layer 123 may also be formed of a dielectric material which can induce the charged particles. Such a dielectric material may include PbO, $B_2O_3$, $SiO_2$, or MgO.

A plurality of fluorescent layers 125 are formed in the discharge cells 126, more particularly, on the upper surface of the second dielectric layer 123 and on sidewalls of the barrier ribs 124. The fluorescent layers 125 are formed by coating one of the red, green, and blue color emitting materials and a fluorescent paste on the upper surface of the second dielectric layer 123 and on the sidewalls of the barrier ribs 124, and then drying and calcining the fluorescent layers 125. The fluorescent paste is a mixture of a solvent and a binder. The red-emitting fluorescent material may be $Y(V, P)O_4$:Eu; the green-emitting fluorescent material may be $Zn_2SiO_4$:Mn, or $YBO_3$:Tb; and the blue-emitting fluorescent material may be BAM:Eu.

In FIGS. 1 and 2, the fluorescent layers 125 are formed on the upper surface of the second dielectric layer 123 and on the sidewalls of the barrier ribs 124. However, the present invention is not limited thereto, as long as the fluorescent layers 125 are formed in the discharge cells 126. The fluorescent layers 125 emit visible rays by receiving UV rays emitted from a discharge gas which is described below.

The discharge gas is charged in the discharge cells 126. The discharge gas is, for example, a Ne—Xe gas including 5-15% Xe. When needed, at least a portion of Ne can be substituted with He. Other gases can also be used. Depending on circumstances, the inside of the discharge cells 126 can be maintained as a vacuum.

To improve discharge efficiency of the PDP 100, more specifically, to effectively diffuse the sustain discharge formed between the first and second sustain electrodes 112 and 113 in the discharge cells 126, the distance between the first and second sustain electrodes 112 and 113 of the pairs of sustain electrodes 114 may be increased to a maximum.

The distance d between the first and second sustain electrodes 112 and 113 of each pair of the sustain electrodes 114 may be greater than the height h of the transverse barrier ribs 1242 or greater than the height of the longitudinal barrier ribs 1241. Here, as the distance d between the first and second sustain electrodes 112 and 113 increases, the first and second sustain electrodes 112 and 113 of each pair of the sustain electrodes 114 can be disposed to correspond to the upper portion of the transverse barrier ribs 1242. Also, as the distance d between the first and second sustain electrodes 112 and 113 increases, the first and second bus electrodes 112*a* and 113*a* of each pair of the sustain electrodes 114 can be disposed to correspond to the upper portion of the transverse barrier ribs 1242. This also applies to embodiments to be described later.

The height h of the transverse barrier ribs 1242 is less than the height of the longitudinal barrier ribs 1241, as described above, so as to allow for the more effective diffusion of the discharge in the discharge cells 126. The efficiency of the diffusion of the discharge may be decreased due to blocking of a portion of the discharge between the first and second sustain electrodes 112 and 113 by the transverse barrier ribs 1242 which extend parallel to the first and second sustain electrodes 112 and 113. As such, the height h of the transverse barrier ribs 1242, in a direction (Z direction of FIG. 1) from the second substrate 121 towards the first substrate 111, is 10~50% less than the height of the longitudinal barrier ribs 1241.

The following table shows relative values of luminance measured in front of a PDP when light from 40% of the total display area is emitted in relation to the height h of the transverse barrier ribs 1242 and the distance d between the sustain electrodes 114 when the longitudinal barrier ribs 1241 have a height of 120 μm. The height h of the transverse barrier ribs 1242 is varied from 120 μm to 50 μm when the distance d between the sustain electrodes 114 is varied from 110 μm to 180 μm.

| Height h of transverse barrier ribs (μm) | Luminance when distance d between sustain electrodes is 110 μm (cd/m$^2$) | Luminance when distance d between sustain electrodes is 120 μm (cd/m$^2$) | Luminance when distance d between sustain electrodes is 130 μm (cd/m$^2$) | Luminance when distance d between sustain electrodes is 160 μm (cd/m$^2$) | Luminance when distance d between sustain electrodes is 180 μm (cd/m$^2$) |
|---|---|---|---|---|---|
| 120 | 340 | 350 | 380 | 410 | 450 |
| 110 | 380 | 400 | 420 | 470 | 490 |
| 100 | 410 | 430 | 450 | 490 | 520 |
| 80 | 410 | 430 | 450 | 490 | 540 |
| 70 | 370 | 380 | 410 | 460 | 490 |
| 60 | 360 | 360 | 400 | 420 | 470 |
| 50 | 330 | 330 | 340 | 350 | 380 |

As shown in the table above, when the distance d between sustain electrodes is fixed, luminance varies according to variation in the height h of the transverse barrier ribs 1242. For example, when the distance d between the sustain electrodes is 110 μm and the height h of the transverse barrier ribs is 120 μm (the same as the height of the longitudinal barrier ribs), the luminance is 340 cd/m$^2$. As the height h of the transverse barrier ribs is lowered to 110 μm, 100 μm, and 80 μm, luminance is increased to 380 cd/m$^2$, 410 cd/m$^2$, and 410 cd/m$^2$, respectively. As the height h of the transverse barrier ribs is further lowered to 70 μm, 60 μm, and 50 μm, luminance is decreased to 370 cd/m$^2$, 360 cd/m$^2$, and 330 cd/m$^2$, respectively.

Accordingly, to improve luminance, the height h of the transverse barrier ribs is lowered but not beyond a certain limit. Referring to the table above, the largest increase in luminance, from 340 to 380 cd/m$^2$, is observed when the height h of the transverse barrier ribs is decreased from 120 μm to 110 μm. And, the largest decrease in luminance, from 360 to 330 cd/m$^2$, is observed when the height h of the transverse barrier ribs is decreased from 60 mm to 50 μm. As a result, when the height h of the longitudinal barrier ribs is 120 μm, the most efficient height of the transverse barrier ribs 1242 is about 60~110 μm, which shows that the most efficient height of the transverse barrier ribs 1242 is about 10~50% less than the height of the longitudinal barrier ribs 1241.

As the height h of the transverse barrier ribs 1242 is less than the height of the longitudinal barrier ribs 1241, the sustain discharge formed between the first and second sustain electrodes 112 and 113 is not blocked by the transverse barrier ribs 1242 and is diffused more effectively throughout the entire space of the discharge cells 126. Accordingly, higher luminance images can be formed on the PDP 100 at lower voltages.

Figure 3:
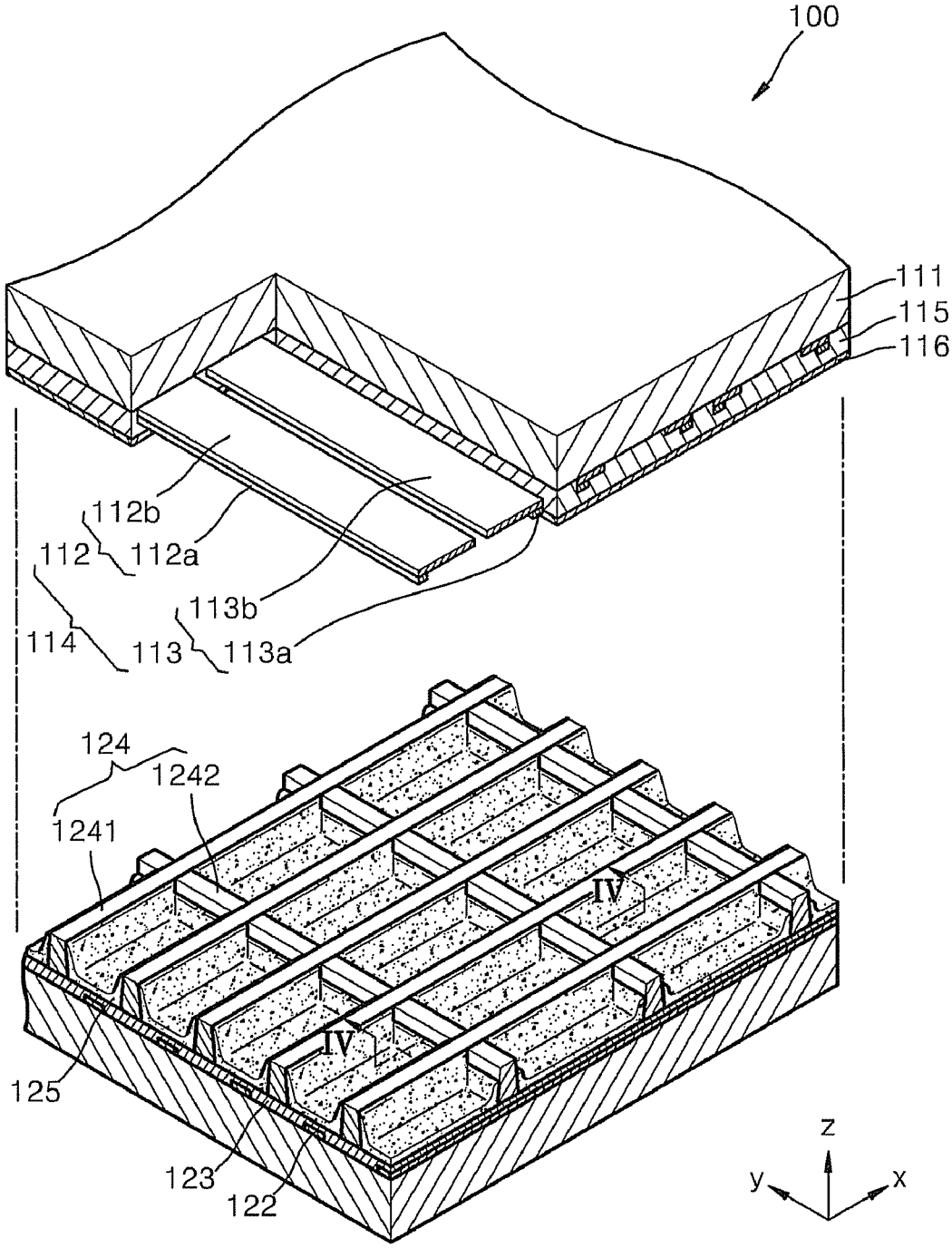
FIG. 3 is a schematic exploded perspective view of a PDP according to another aspect of the present invention.
Figure 4:
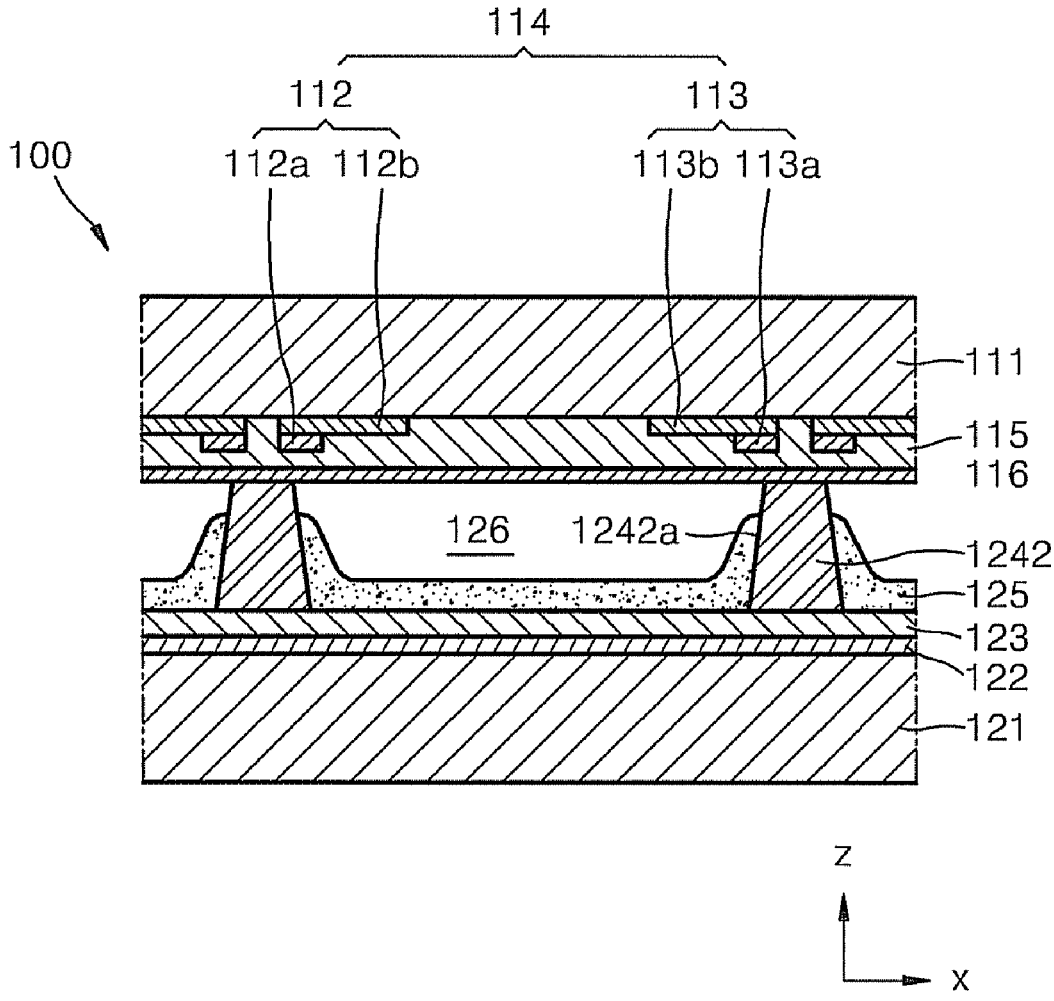
FIG. 4 is a schematic cross-sectional view of the PDP taken along a line IV-IV illustrated in FIG. 3.

FIG. 3 is a schematic exploded perspective view of a PDP 100 according to another aspect of the present, and FIG. 4 is a schematic cross-sectional view of the PDP 100 taken along a line IV-IV illustrated in FIG. 3.

In the PDP 100, the height of longitudinal barrier ribs 1241 may be equal to the height of transverse barrier ribs 1242, which connect the longitudinal barrier ribs 1241. However, in the PDP 100 according to aspects of the current embodiment, the fluorescent layers 125 disposed in discharge cells 126 are formed in a different shape from the shape of the fluorescent layers 125 in the PDP according to aspects of the previous embodiment. More specifically, the fluorescent layers 125 are formed to expose the upper ends of sidewalls 1242*a* (FIG. 4) of the transverse barrier ribs 1242, meaning that the end of the sidewalls 1242*a* of the transverse barrier ribs 1242 nearer a first substrate 111 are not covered by the fluorescent layers 125.

In conventional PDPs, fluorescent layers are formed to cover sidewalls of transverse barrier ribs to the upper ends thereof. Accordingly, the thickness of the transverse barrier ribs together with the fluorescent layers near the first and second sustain electrodes is large when considering both thicknesses of the transverse barrier ribs and the fluorescent layers. As a result, a sustain discharge formed between the first and second sustain electrodes is blocked by the fluorescent layers and the transverse barrier ribs, and thus, the sustain discharge is not diffused efficiently throughout the discharge cells.

Referring back to FIGS. 3 and 4, by not forming the fluorescent layers 125 on the sidewalls 1242*a* of the transverse barrier ribs 1242 to the upper ends thereof in a direction from the second substrate 121 towards the first substrate 111 in the PDP 100, the fluorescent layers 125 are not formed near the first and second sustain electrodes 112 and 113. Therefore, the sustain discharge formed between the first and second sustain electrodes 112 and 113 is not blocked by the fluorescent layers 125. Consequently, the sustain discharge formed between the first and second sustain electrodes 112 and 113 can be diffused more effectively to the whole volume of the discharge cells 126. Such increase in efficiency of diffusion results in higher luminance images formed on the PDP 100 at lower voltages.

In FIGS. 3 and 4, the fluorescent layers 125 are formed to partially cover the sidewalls 1242*a* of the transverse barrier ribs formed in a direction from the second substrate 121 towards the upper ends of the transverse barrier ribs 1242; however, the upper ends of the transverse barrier ribs 1242 remain exposed. The height of the fluorescent layers 125 formed on the sidewalls 1242*a* of the transverse barrier ribs 1242 may be less than the height of the fluorescent layers 125 of the sidewalls of the longitudinal barrier ribs 1241. The longitudinal barrier ribs 1241 do not block the sustain discharge between the first and second sustain electrodes 112 and 113.

Figure 5:
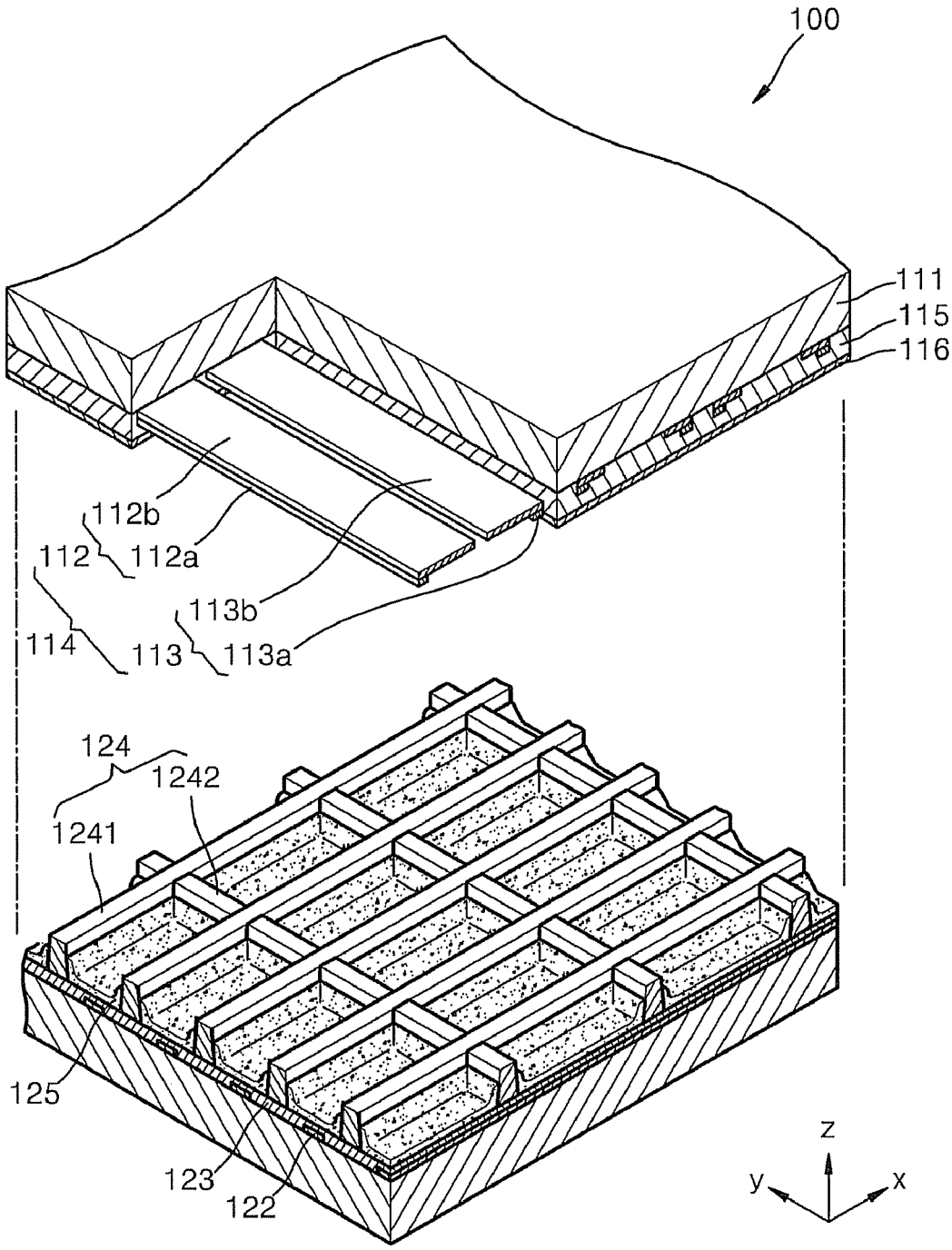
FIG. 5 is a schematic exploded perspective view of a PDP according to another aspect of the present invention.

FIG. 5 is a schematic exploded perspective view of a PDP 100 according to other aspects of the present invention. As in FIGS. 3 and 4, fluorescent layers 125 only partially cover the transverse barrier ribs 1242, leaving the upper ends near the sustain electrodes 114 exposed. Additionally here, the fluorescent layers 125 only partially cover the sidewalls of the longitudinal barrier ribs 1241, leaving the upper ends near the sustain electrodes 114 exposed. The present invention is not limited thereto.

Figure 6:
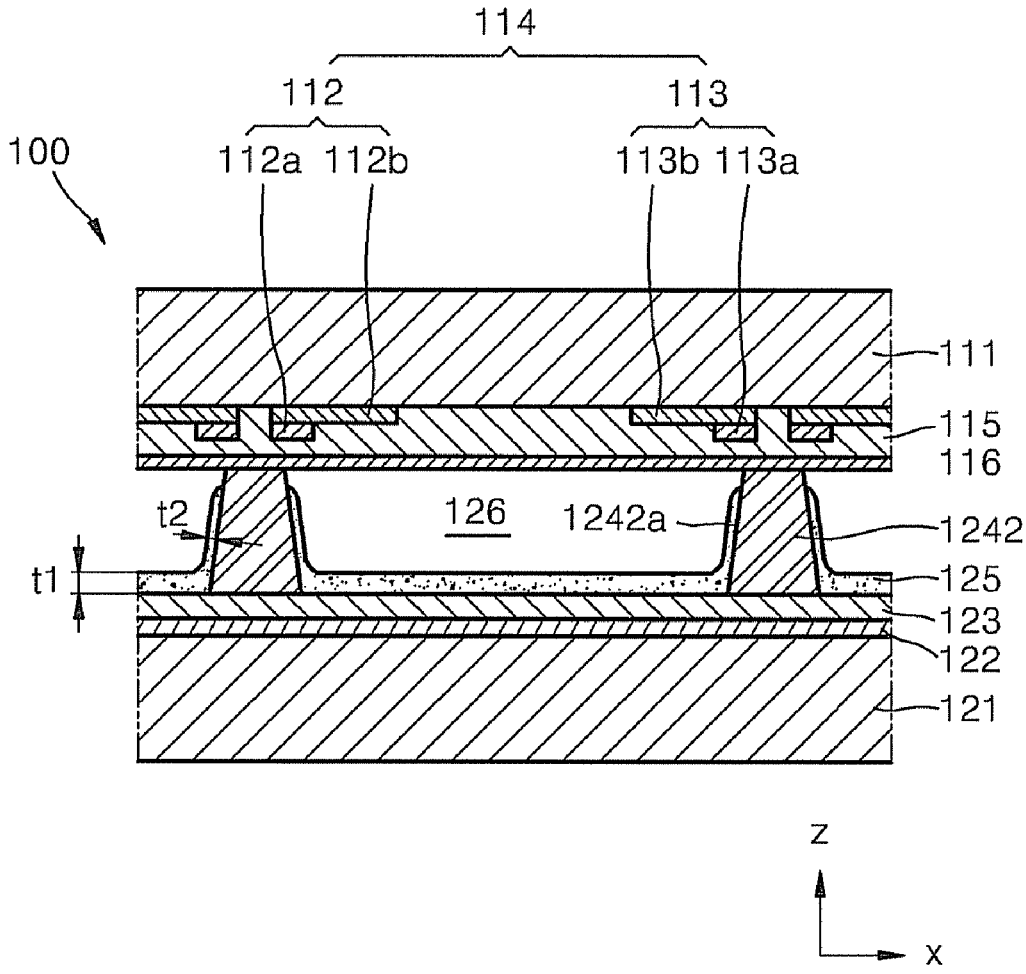
FIG. 6 is a schematic cross-sectional view of a PDP according to another aspect of the present invention.

FIG. 6 is a schematic cross-sectional view of a PDP 100 according to aspects of the present invention.

In the PDP 100, according to aspects of the current embodiment, the fluorescent layers 125 are formed on the sidewalls 1242*a* of the transverse barrier ribs 1242 not completely to the upper ends thereof in a direction from the second substrate 121 towards a first substrate 111. Additionally, the fluorescent layers 125 have a thickness t2 of the fluorescent layers 125 formed on the sidewalls 1242*a* of the transverse barrier ribs 1242 that is less than a thickness t1 of the fluorescent layers 125 formed on the second substrate 121 or the second dielectric 123. By forming the fluorescent layers 125 near the first and second sustain electrodes 112 and 113 thinner than the fluorescent layers 125 on other portions of the PDP 100, a sustain discharge formed between the first and second sustain electrodes 112 and 113 is not blocked by the neighboring fluorescent layers 125 and is diffused effectively and more efficiently into the discharge cells 126. Accordingly, discharge efficiency is improved and discharge voltage is lowered such that higher luminance images can be formed on the PDP 100 at lower voltages.

In the PDP, according to aspects of the present invention, higher luminance images can be formed at lower voltages.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A plasma display panel (PDP), comprising:

first and second substrates which face each other with a predetermined space therebetween;

a plurality of barrier ribs disposed between the first and second substrates, comprising longitudinal barrier ribs extending in a first direction and transverse barrier ribs having a height less than a height of the longitudinal barrier ribs and connecting the longitudinal barrier ribs, the plurality of barrier ribs defining a plurality of discharge cells together with the first and second substrates;

a plurality of pairs of sustain electrodes disposed on the first substrate, extending in a second direction to cross the longitudinal barrier ribs and corresponding to the discharge cells, each pair of the sustain electrodes comprising first and second sustain electrodes separated by a distance from each other;

a plurality of address electrodes disposed on the second substrate to cross the pairs of sustain electrodes; and a fluorescent layer formed in each of the discharge cells, wherein the distance between the first and second sustain electrodes of each pair of the sustain electrodes is greater than the height of the transverse barrier ribs.

2. The PDP of claim 1, wherein the distance between the first and second sustain electrodes of each pair of the sustain electrodes is greater than the height of the longitudinal barrier ribs.

3. The PDP of claim 1, wherein the first and second sustain electrodes of each pair of the sustain electrodes are disposed to correspond to the upper portion of the transverse barrier ribs.

4. The PDP of claim 3, wherein the first sustain electrodes are disposed to correspond to the upper portion of the transverse barrier ribs, and the second sustain electrodes are disposed to correspond to the upper portion of adjacent transverse barrier ribs.

5. The PDP of claim 1, wherein the first and second sustain electrodes of each pair of the sustain electrodes further comprise first and second bus electrodes, respectively, and the first bus electrodes are disposed adjacent to the edge aligned with the transverse barrier ribs, and the second bus electrodes are disposed adjacent to the edge aligned with adjacent transverse barrier ribs.

6. The PDP of claim 1, wherein the transverse barrier ribs have a height about 10% to 50% lower than the longitudinal barrier ribs.

7. A plasma display panel (PDP), comprising:

first and second substrates which face each other with a predetermined space therebetween;

a plurality of barrier ribs disposed between the first and second substrates, comprising longitudinal barrier ribs extending in a first direction and transverse barrier ribs connecting the longitudinal barrier ribs, the plurality of barrier ribs defining a plurality of discharge cells together with the first and second substrates;

a plurality of pairs of sustain electrodes disposed on the first substrate, extending in a second direction to cross the longitudinal barrier ribs and correspond to the discharge cells, and each pair of the sustain electrodes comprising first and second sustain electrodes separated by a distance from each other;

a plurality of address electrodes disposed on the second substrate to cross the pairs of sustain electrodes; and a fluorescent layer formed in each of the discharge cells, the fluorescent layer being formed on sidewalls of the transverse barrier ribs to expose upper ends of the sidewalls of the transverse barrier ribs, the upper ends of the sidewalls being disposed away from the second substrate.

8. The PDP of claim 7, wherein the distance between the first and second sustain electrodes of each pair of the sustain electrodes is greater than a height of the transverse barrier ribs.

9. The PDP of claim 7, wherein a height of the fluorescent layers formed on the sidewalls of the transverse barrier ribs is less than a height of the fluorescent layers formed on sidewalls of the longitudinal barrier ribs.

10. The PDP of claim 7, wherein the distance between the first and second sustain electrodes of each pair of the sustain electrodes is greater than a height of the barrier ribs.

11. The PDP of claim 7, wherein the first and second sustain electrodes of each pair of the sustain electrodes are disposed to correspond to the upper portion of the transverse barrier ribs.

12. The PDP of claim 11, wherein the first sustain electrodes are disposed to correspond to the upper portion of the transverse barrier ribs, and the second sustain electrodes are disposed to correspond to the upper portion of adjacent transverse barrier ribs.

13. The PDP of claim 7, wherein the first and second sustain electrodes of each pair of the sustain electrodes further comprise first and second bus electrodes, respectively, and the first bus electrodes are disposed to correspond to the upper portion of the transverse barrier ribs, and the second bus electrodes are disposed to correspond to the upper portion of adjacent transverse barrier ribs.

14. A plasma display panel (PDP), comprising:

first and second substrates which face each other with a predetermined space therebetween;

a plurality of barrier ribs disposed between the first and second substrates, comprising longitudinal barrier ribs extending in a first direction and transverse barrier ribs connecting the longitudinal barrier ribs, the plurality of barrier ribs defining a plurality of discharge cells together with the first and second substrates;

a plurality of pairs of sustain electrodes disposed on the first substrate, extending in a second direction to cross the longitudinal barrier ribs and correspond to the discharge cells, and each pair of the sustain electrodes comprising first and second sustain electrodes separated by a distance from each other;

a plurality of address electrodes disposed on the second substrate to cross the pairs of sustain electrodes; and a fluorescent layer formed in each of the discharge cells, in which a thickness of the fluorescent layer formed on sidewalls of the transverse barrier ribs is less than a thickness of the fluorescent layer formed on the second substrate.

15. The PDP of claim 14, wherein the distance between the first and second sustain electrodes of each pair of the sustain electrodes is greater than a height of the barrier ribs.

16. The PDP of claim 14, wherein the first and second sustain electrodes of each pair of the sustain electrodes are disposed to correspond to an upper portion of the transverse barrier ribs.

17. The PDP of claim 16, wherein the first sustain electrodes are disposed to correspond to the upper portion of the transverse barrier ribs, and the second sustain electrodes are disposed to correspond to the upper portion of adjacent transverse barrier ribs.

18. The PDP of claim 14, wherein the first and second sustain electrodes of each pair of the sustain electrodes further comprise first and second bus electrodes, respectively, and the first bus electrodes are disposed to correspond to the upper portion of the transverse barrier ribs, and the second bus electrodes are disposed to correspond to the upper portion of adjacent transverse barrier ribs.

19. The PDP of claim 14, further comprising a dielectric layer to cover the address electrodes.

20. The PDP of claim 14, wherein a height of the transverse barrier ribs is less than a height of the longitudinal barrier ribs.

21. The PDP of claim 14, wherein the fluorescent layer is formed on sidewalls of the transverse barriers to expose upper ends of the sidewalls of the transverse barriers closest to the sustain electrodes.

22. A plasma display panel (PDP), comprising:

first and second substrates which face each other with a predetermined space therebetween;

a plurality of barrier ribs disposed between the first and second substrates, comprising longitudinal barrier ribs extending in a first direction and transverse barrier ribs connecting the longitudinal barrier ribs, the plurality of barrier ribs defining a plurality of discharge cells together with the first and second substrates;

a plurality of pairs of sustain electrodes disposed on the first substrate, extending in a second direction to cross the longitudinal barrier ribs and correspond to the discharge cells, and each pair of the sustain electrodes comprising first and second sustain electrodes separated by a distance from each other a plurality of address electrodes disposed on the second substrate to cross the pairs of sustain electrodes; and a fluorescent layer formed in each of the discharge cells, wherein a height of the fluorescent layer formed on sidewalls of the transverse barrier ribs is lower than a height of the longitudinal barrier ribs.

23. The PDP of claim 22, wherein the first sustain electrodes are disposed to correspond to the upper portion of the transverse barrier ribs, and the second sustain electrodes are disposed to correspond to the upper portion of adjacent transverse barrier ribs.

24. The PDP of claim 22, wherein the first and second sustain electrodes of each pair of the sustain electrodes further comprise first and second bus electrodes, respectively, and the first bus electrodes are disposed to correspond to the upper portion of the transverse barrier ribs, and the second sustain electrodes are disposed to correspond to the upper portion of adjacent transverse barrier ribs.

* * * * *

UNITED STATES PATENT AND TRADEMARK OFFICE

CERTIFICATE OF CORRECTION

PATENT NO. : 7,728,524 B2
APPLICATION NO. : 11/693996
DATED : June 1, 2010
INVENTOR(S) : Tae-Kyoung Kang It is certified that error appears in the above-identified patent and that said Letters Patent is hereby corrected as shown below:

Column 12, line 23, insert --;-- after "each other".

Signed and Sealed this

Twenty-fourth Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,728,524 B2
APPLICATION NO. : 11/693996
DATED : June 1, 2010
INVENTOR(S) : Tae-Kyoung Kang It is certified that error appears in the above-identified patent and that said Letters Patent is hereby corrected as shown below:

Column 12, line 23, insert --;-- after "each other".

Signed and Sealed this

Thirty-first Day of August, 2010

David J. Kappos

David J. Kappos
*Director of the United States Patent and Trademark Office*